United States Patent [19]

LaRue et al.

[11] 4,352,285

[45] Oct. 5, 1982

[54] HYDRAULIC WEDGE MANDREL

[75] Inventors: Forrest N. LaRue, Sand Spring, Okla.; Lionel H. Wheeler, Houston, Tex.

[73] Assignee: Crutcher Resources Corporation, Houston, Tex.

[21] Appl. No.: 73,022

[22] Filed: Sep. 6, 1979

[51] Int. Cl.[3] ..... B21D 9/01

[52] U.S. Cl. ..... 72/466; 72/398

[58] Field of Search ..... 72/355, 392, 398, 452, 72/466, 478

[56] References Cited

U.S. PATENT DOCUMENTS

| | | | |
|---|---|---|---|
| 174,608 | 3/1876 | Wright | 72/466 |
| 336,854 | 2/1886 | Higgins | 72/398 |
| 856,896 | 6/1907 | McCormick . | |
| 2,380,344 | 7/1945 | Sutton . | |
| 2,401,052 | 5/1946 | Cummings | 72/478 |
| 2,734,120 | 2/1956 | Sensenig . | |
| 2,734,749 | 2/1956 | Benjamin . | |
| 2,835,498 | 5/1958 | Howes . | |
| 3,109,477 | 11/1963 | Avera et al. . | |
| 3,115,798 | 12/1963 | Donaway . | |
| 3,117,797 | 1/1964 | Buck . | |
| 3,383,723 | 5/1968 | Connelly . | |
| 3,747,394 | 7/1973 | Cunningham . | |
| 3,834,210 | 9/1974 | Clavin et al. . | |
| 3,851,519 | 12/1974 | Clavin et al. | 72/466 |
| 4,086,803 | 5/1978 | Wheeler . | |

FOREIGN PATENT DOCUMENTS 288198 1/1971 U.S.S.R. .

*Primary Examiner*—Lowell A. Larson

*Attorney, Agent, or Firm*—Richards, Harris & Medlock

[57] ABSTRACT

A hydraulic wedge mandrel is disclosed for supporting top and bottom cylindrical segments of pipe during cold bending of the pipe. Bottom and top assemblies (14) and (16) are vertically movable to and away from each other for expanding and collapsing the mandrel. Bottom and top arcuate support segments (18) and (22) support the bottom and top assemblies (14) and (16) respectively. Bottom spring plate (20) is mounted to bottom arcuate support segments (18) opposite bottom assembly (14) and top spring plate (24) is mounted to top arcuate support segments (22) opposite top assembly (16). Secured to the top of bottom spring plate (20) and the bottom of top spring plate (24) are a plurality of wedges (28). Secured to center spring plate (26) located between bottom and top spring plates (20) and (24) are complementary wedges (30) which traverse and supportably engage wedges (28) when center spring plate (26) is moved longitudinally of bottom spring plate (20) and top spring plate (24) to move bottom and top assemblies (14) and (16) apart and in engagement with cylindrical segments of a pipe.

15 Claims, 6 Drawing Figures

HYDRAULIC WEDGE MANDREL

TECHNICAL FIELD

This invention relates to the cold bending of metallic pipe and more particularly the cold bending of thin wall, high strength alloy, large diameter pipe in which the pipe bending apparatus includes a flexible mandrel adapted for expansion inside the pipe to be bent to provide support for certain areas of the pipe during the bending operation to maintain the pipe in a smooth and circular shape at the zone to bend.

BACKGROUND ART

A pipe bending mandrel that is expandable is disclosed in U.S. Pat. No. 3,109,177 to Avera et al. The mandrel disclosed in the Avera patent comprises a plurality of longitudinally spaced expansion units for radial expansion, each unit having a ring assembly secured to the mandrel frame so that a plurality of radially reciprocal rams extend to a single locked position for contacting the pipe along an interior circumference.

U.S. Pat. No. 3,851,519 to Clavin et al. discloses an internal pipe supporting mandrel having upper and lower assemblies that are movable away from and toward each other for expanding and collapsing the mandrel. The upper and lower assemblies are moved apart by transverse movement of bosses mounted between the upper and lower assemblies against cam surfaces secured to the upper and lower assemblies thereby moving apart the upper and lower assemblies. When the mandrel is fully expanded, the bosses are in engagement with flat shoulders on the upper and lower assemblies to lock the mandrel in a single expanded position which also represents the maximum distance that the upper and lower assemblies may be separated.

U.S. Pat. No. 4,086,803 to Wheeler discloses an internal pipe supporting mandrel that expands radially to contact the interior of a pipe in which a plurality of segments are connected together and expand radially by movement of spherical members over tapered sections of the segments.

A need exists for an economical, flexible, vertically expandable mandrel of simple design and construction that expands by longitudinal movement in which the mandrel is capable of applying a predetermined variable supporting force to top and bottom interior cylindrical segments of pipe sections despite variations in size from section to section and despite wear of the mandrel that may occur from repeated use.

DISCLOSURE OF THE INVENTION

In accordance with the present invention a pipe bending mandrel is provided for internally supporting cylindrical segments of pipe during bending in the zone where bending occurs.

The structure of the mandrel allows it to be inserted into the pipe in a collapsed position and expanded so that cylindrical segments at the top an bottom of the pipe are supported by the mandrel.

The mandrel provided according to the invention includes a top assembly that defines a top cylindrical segment and a bottom assembly that defines a bottom cylindrical segment, which are vertically movable to and away from each other. A center spring plate incorporates a series of wedges that are complementary to and engageable with sets of wedges secured to top and bottom spring plates to allow vertical movement of the top and bottom assemblies, when the center assembly is moved longitudinally relative to the top and bottom spring plates. Each wedge member has first and second wedge surfaces, the first having a greater degree of vertical inclination than the second, the wedge surfaces being arrayed so that when moving the center assembly longitudinally to expand the mandrel from a collapsed to an expanded position, the first wedge surfaces of the center spring plate engage and traverse the first wedge surfaces of the top and bottom spring plates thereby moving apart vertically the top and bottom spring plates. Further longitudinal movement of the center spring plate causes the second wedge surfaces of the center spring plate to engage and traverse the second wedge surfaces of the top and bottom spring plates to move the mandrel into the expanded position in which the top and bottom assemblies supportably engage top and bottom sections of the pipe. Thus, longitudinal movement of the center spring plate to expand the mandrel comprises an expanding stroke which is divided into two distinct phases where contact between the wedge surfaces occurs. The first phase, in which the first wedge surfaces are engaged, causes the top and bottom assemblies to separate at a relatively high rate and relatively low mechanical advantage. The second phase of the expansion stroke, in which the second wedge surfaces are engaged, separates the top and bottom assemblies further at a relatively low rate and relatively high mechanical advantage. The mandrel is in the epanded position when the second wedge surfaces are engaged so that the distance between the top and bottom assemblies in the expanded position is variable. Thus, it is possible to achieve the desired degree of support during the bending of the pipe despite variations that may occur in the pipe size and to compensate for wear that may occur from repeated use of the mandrel.

A drive assembly is provided for movement of the mandrel longitudinally into, along and out of the pipe.

BRIEF DESCRIPTION OF THE DRAWINGS

A more complete understanding of the invention and its advantages will be apparent from the following detailed description taken in conjunction with the accompanying drawings in which.

DETAILED DESCRIPTION

Figure 1:
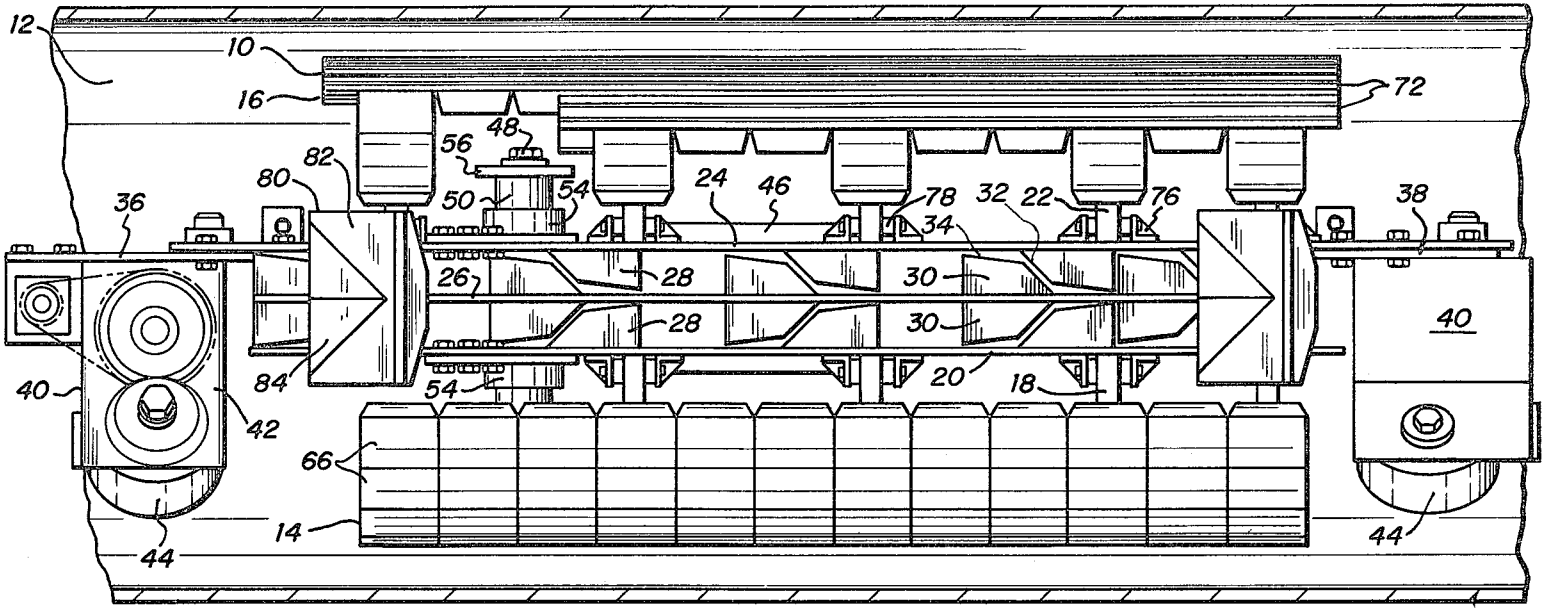
FIG. 1 is a side elevation view of the mandrel in a collapsed position located within a pipe.
Figure 2:
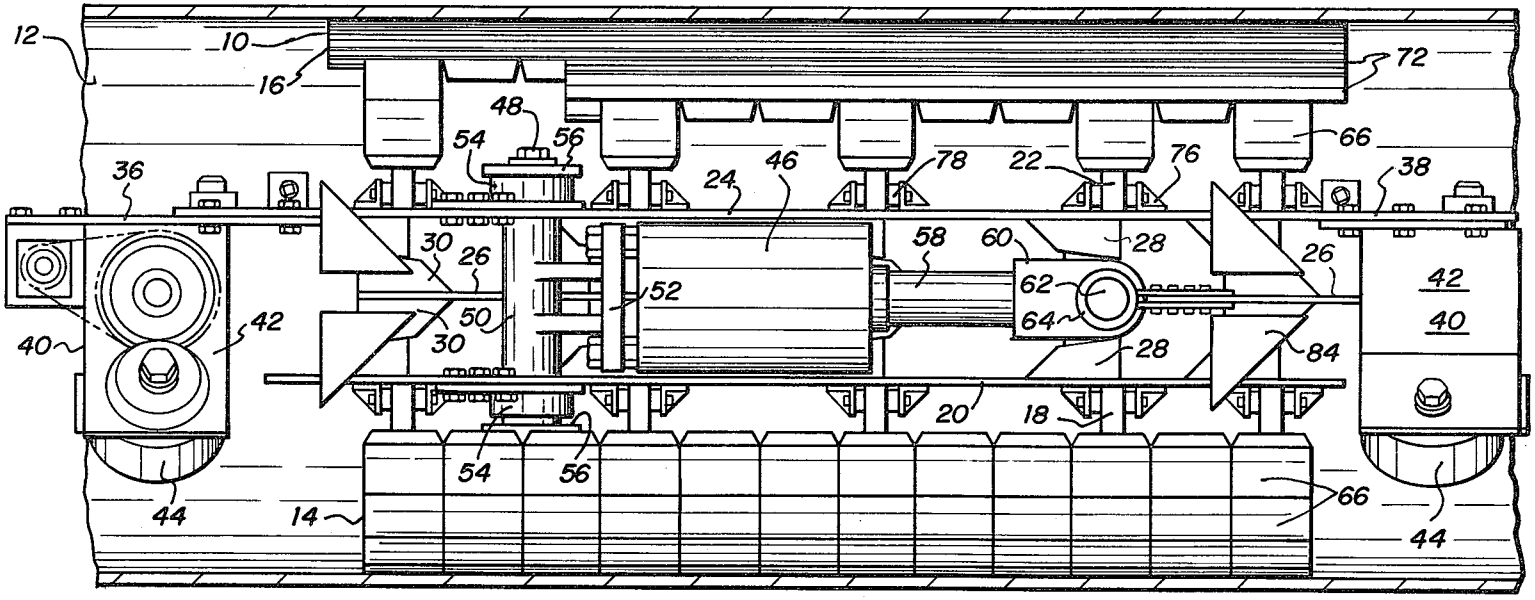
FIG. 2 is a side elevation view partially cut away showing the mandrel in the expanded position supporting top and bottom cylindrical segments of a pipe.
Figure 3:
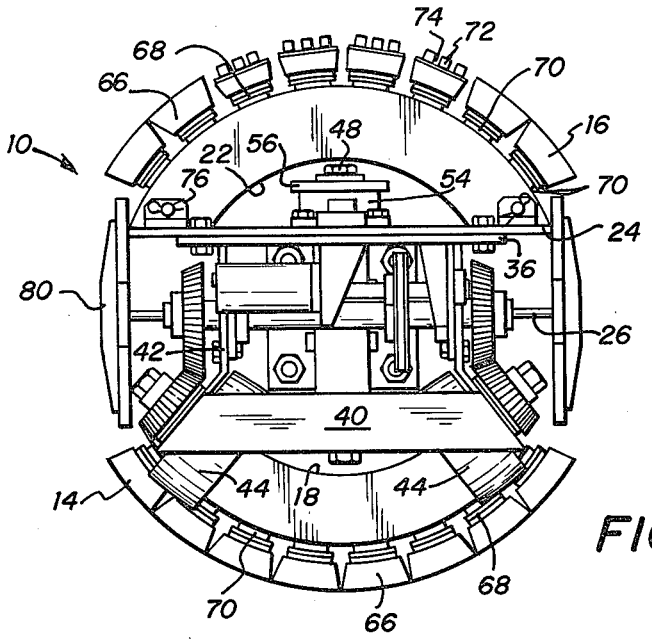
FIG. 3 is an end elevation view showing the mandrel in an expanded position.

The hydraulic wedge mandrel of the present invention is illustrated in FIGS. 1, 2 and 3. Hydraulic wedge mandrel 10 is shown in FIG. 1 in a collapsed position within pipe 12. Bottom assembly 14 defines a bottom cylindrical segment which conforms to the interior surface of pipe 12. Top assembly 16 defines a top cylindrical segment which conforms to the interior surface of pipe 12. Bottom assembly 14 and top assembly 16 are movable away from each other in a manner to be hereinafter explained for supportable engagement with pipe 12. Bottom assembly 14 is mechanically connected to a plurality of bottom arcuate support segments 18. Bottom spring plate 20 is secured to bottom arcuate support segments 18. A plurality of top arcuate support segments 22 preferably correspond in size and number with bottom arcuate support segments 18 and are in vertical alignment with bottom arcuate support segments 18. Top arcuate support segments 22 are mechanically secured to top assembly 16 and top spring plate 24. Bottom spring plate 20 is separated from top spring plate 24 by means of center spring plate 26. Center spring plate 26 is longitudinally translatable relative to the top and bottom cylindrical segments defined by top assembly 16 and bottom assembly 14, said longitudinal movement of center spring plate 26 also being relative to said top and bottom assemblies 16 and 14, respectively. Said longitudinal translation of center spring plate 26 also causes bottom assembly 14 and top assembly 16 to move vertically to and away from each other in a manner to be hereinafer described.

According to the preferred embodiment of the invention, bottom assembly 14 and top assembly 16 are spaced apart less than the diameter of the cylinder defined by bottom assembly 14 and top assembly 16 when hydraulic wedge mandrel 10 is in the collapsed position.

Hydraulic wedge mandrel 10 is preferably used in conjunction with a pipe bending machine capable of bending large diameter pipe. Such a machine usually includes a pin up end which is the end of the machine into and out of which the pipe is moved and a stiff back end which is the other end of the machine. The machine includes a main frame to which a longitudinally convex and transversely concave elongated bending dye is secured intermediate the length of the main frame, the face of the die being positioned downwardly so that the pipe is bent by lifting the pipe upwardly against the die. The machine further includes a transversely concave elongated stiff back for bending the pipe against the die and a transversely concave pin up shoe for supporting the pipe adjacent the pin up end. One such pipe bending machine is described in U.S. Pat. No. 3,834,210 to Clavin et al.

Hydraulic wedge mandrel 10 provides support for the interior of pipe 12 adjacent the pipe bending die during bending. Top assembly 16 is in contact with a portion of the pipe associated with the bending die which is the portion of the pipe that is compressed by the bending operation. Bottom assembly 14 is in contact with the portion of the pipe associated with the stiff back which is the portion of the pipe that is expanded or stretched during the bending operation. No internal support for the pipe is required between bottom assembly 14 and top assembly 16 because the pipe in that area does not tend to buckle, wrinkle or crimp during bending.

Sets of wedges 28 are secured to bottom spring plate 20 and top spring plate 24. One member of each set of wedges 28 being secured to the top of bottom spring plate 20 and the other wedge 28 being secured to the bottom of top spring plate 24, as shown in FIG. 1. Complementary wedges 30, which are complementary with wedges 28 are secured to the top and bottom of center spring plate 26. Complementary wedges 30 are engageable with wedges 28. In the preferred embodiment each of wedges 28 and complementary wedges 30 have first surfaces 32 and second surfaces 34. As shown in FIG. 1, first surface 32 has a greater degree of vertical inclination than said second surface 34.

FIG. 1 illustrates hydraulic wedge mandrel 10 in a collapsed or first position. Secured to the two ends of top spring plate 24 are end plates 36 and 38. Secured to each of the end plates 36 and 38 is downwardly extending wheel support assembly 40 which includes supporting arms 42. At least two wheels 44 are rotatably attached to each of wheel support assemblies 40, and support hydraulic wedge mandrel 10 when in a collapsed position. Power means are mechanically coupled to wheels 44 and are located within wheel support assembly 40 on one end of the mandrel to provide rotational force to wheels 44 thereby moving hydraulic wedge mandrel 10, when in a collapsed position. When hydraulic wedge mandrel 10 is in an expanded position, as shown in FIG. 2, wheels 44 are no longer in engagement with pipe 12 and thus do not support hydraulic wedge mandrel 10, since as hydraulic wedge mandrel 10 is expanded, top assembly 16 moves upwardly and thereby moves wheels 44 upwardly and out of contact with pipe 12.

Figure 4:
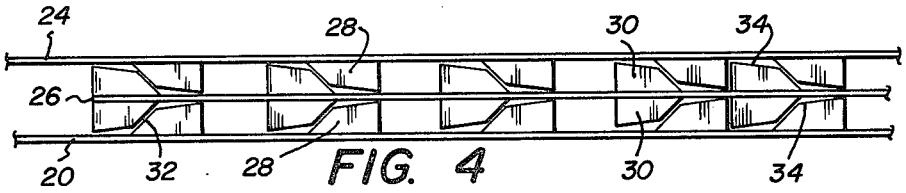
FIG. 4 is a side elevation view of the wedge surfaces in a collapsed position.
Figure 5:
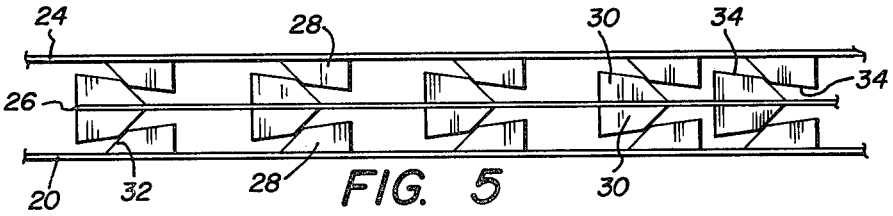
FIG. 5 is a side elevation view showing the wedge surfaces in a partially expanded position.
Figure 6:
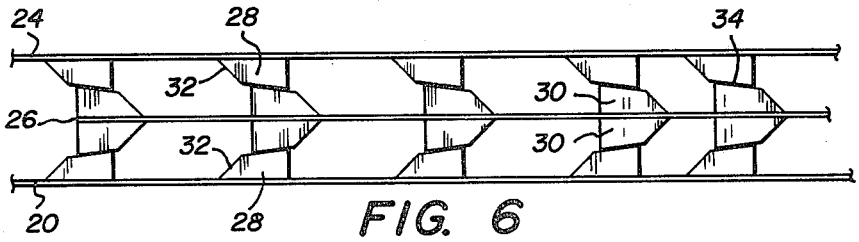
FIG. 6 is a side elevation view showing the wedge surfaces in an expanded position.

When it is desired to expand hydraulic wedge mandrel 10 from a collapsed or first position to an expanded or second position, center spring plate 26 is moved longitudinally relative to bottom spring plate 20 and top spring plate 24 so that first surfaces 32 of complementary wedges 30 engage and traverse first surfaces 32 of wedges 28, as shown in FIG. 5, to move bottom spring plate 20 and top spring plate 24 away from each other, thereby moving bottom assembly 14 and top assembly 16 vertically away from each other. As center spring plate 26 continues moving longitudinally relative to bottom spring plate 20 and top spring plate 24, second surfaces 34 of complementary wedges 30 traverse and engage second surfafces 34 of wedges 28, moving bottom spring plate 20 and top spring plate 24 further apart and force bottom assembly 14 and top assembly 16 to engage the bottom and top of pipe 12, respectively. FIG. 6 illustrates the engagement of second surfaces 34 of complementary wedges 30 with second surfaces 34 of wedges 28 in a second or expanded position of hydraulic wedge mandrel 10. It is convenient to term the movement of center spring plate 26, in which hydraulic wedge mandrel 10 moves from a collapsed position to an expanded position, as the expanding stroke, the beginning zone of the stroke being illustrated in FIG. 4 where wedges 28 and complementary wedges 30 are not in contact or traversing each other, to an intermediate zone where first surfaces 32 of complementary wedges 30 engage and traverse first surfaces 32 of wedges 28 to move bottom assembly 14 and top assembly 16 apart, and a final zone in which longitudinal movement of center spring plate 26 engages and traverses second surfaces 34 of complementary wedges 30 with second surfaces 34 of wedges 28 moving said hydraulic wedge mandrel 10 into the second or expanded position in which bottom assembly 14 and top assembly 16 contact and supportably engage bottom and top cylindrical segments of a pipe, the final zone of the expanding stroke of center spring plate 26 illustrated in FIG. 6. Similarly, when it is desired to collapse hydraulic wedge mandrel 10, center spring plate 26 moves in a longitudinal direction opposite to the longitudinal direction of the expanding stroke. The beginning of the collapsing stroke is illustrated in FIG. 6, the intermediate zone being illustrated by FIG. 5 and the final zone of the collapsing stroke being illustrated in FIG. 4.

During the expansion stroke, hydraulic wedge mandrel 10 first begins to expand in the intermediate zone of the expanding stroke. Most of the expansion of hydraulic wedge mandrel 10 occurs during the intermediate zone of the expanding stroke of center spring plate 26. This expansion takes place at a relatively low mechanical advantage compared to the expansion that occurs in the final zone of the expanding stroke in which longitudinal movement of center spring plate 26 causes second surfaces 34 of complementary wedges 30 to engage and traverse second surfaces 34 of wedges 28 to move bottom assembly 14 and top assembly 16 into contact with the bottom and top of pipe 12. This is advantageous, since during expansion in the intermediate zone, the resistance to expansion is essentially caused only by the weight of hydraulic wedge mandrel 10, and during the final zone of the expanding stroke, bottom assembly 14 and top assembly 16 contact and supportably engage pipe 12 where it is advantageous to be able to apply a known and predetermined force to support interior cylindrical segments of pipe 12 during bending. Since hydraulic wedge mandrel 10 is in the expanded position when second surfaces 34 of complementary wedges 30 engage with second surfaces 34 of wedges 28, the size of the mandrel (i.e., the distance between bottom assembly 14 and top assembly 16 is variable in the expanded position. Therefore, according to the invention, the desired degree of support in a pipe during a bending operation can be consistently achieved despite variations that may occur in pipe size. Similarly, hydraulic wedge mandrel 10 can automatically compensate for wear that may occur from repeated use, such as a wearing down of the exterior of bottom assembly 14 and top assembly 16 or of wedges 28 and complementary wedges 30.

FIG. 2 illustrates the preferred apparatus for moving center spring plate 26 longitudinally relative to bottom assembly 14 and top assembly 16, for expanding and collapsing hydraulic wedge mandrel 10. Preferably, double acting hydraulic cylinder assembly 46 is used to move center spring plate 26 longitudinally of bottom assembly 14 and top assembly 16. Guide 48 includes cylindrical body 50 which is attached to blind end 52 of hydraulic assembly 46, and guide 48 further includes annular collars 54, one attached to bottom spring plate 20 and the other attached to top spring plate 24 in coaxial alignment with cylindrical body 50, for movement along cylindrical body 50 when bottom spring plate 20 and top spring plate 24 are moved to or away from each other. Secured to each end of cylindrical body 50 are stop plates 56 which prevent further separation of bottom spring plate 20 and top spring plate 24. Hydraulic cylinder 46 contains therein a piston (not shown) to which is connected one end of rod 58, the other end of rod 58 being connected to rod eye 60. Shaft 62 extends through rod eye 60 and bearing sleeves 64. Bearing sleeves 64 are located on either side of rod eye 60 and are secured to center spring plate 26.

Bottom assembly 14 and top assembly 16 define bottom and top cylindrical segments of a pipe to be bent. Top assembly 16 is in contact with a portion of the pipe that contacts the bending die during bending and is the portion of the pipe which is compressed by the bend. Bottom assembly 14 is in contact with a portion of the pipe that is associated with a stiff back which is the portion of the pipe that is expanded or stretched by the bending operation. No internal support for the pipe between top assembly 16 and bottom assembly 14 is required because the pipe in that area does not tend to buckle, wrinkle or crimp during the bending operation, and accordingly, no internal support is provided in those areas by hydraulic wedge mandrel 10. As shown in FIG. 3, bottom assembly 14 includes blocks 66 arrayed to define a bottom cylindrical segment. Blocks 66 are preferably constructed from hard rubber in the durometer range of 85 to 95. Preferably, there are eight longitudinal rows of blocks 66 that define the bottom cylindrical segment of hydraulic wedge mandrel 10. Blocks 66 are secured to a plurality of pairs of buckle resisting springs 68. Preferably there are eight sets of buckle resisting springs 68. Buckle resisting springs 68 are secured to bottom arcuate support segments 18, and are separated from bottom arcuate support segments 18 by circular rubber spacers 70.

Top assembly 16 is similar to bottom assembly 14 except that in the preferred embodiment, top assembly 16 includes a plurality of buckle resisting spring strips 72 that define a portion of the top cylindrical segment and are mounted within longitudinal grooves 74 in the exterior surface of blocks 66 so that the exterior surfaces of buckle resisting spring strips 72 are flush with the surfaces of blocks 66. Buckle resisting spring strips 72 contact the pipe in the area where it is compressed during bending.

Preferably, there are five bottom arcuate support segments 18 and five top arcuate support segments 22. Bottom and top arcuate support segments 18 and 22 are mounted to their respective spring plates 20 and 24 in vertical alignment. Preferably, the end of hydraulic wedge mandrel 10 that is on the stiff back end of the pipe bending machine has more rigidity than other portions of hydraulic wedge mandrel 10. Therefore, as shown in FIG. 2 the first two bottom and top arcuate support segments 18 and 22 from the right of FIG. 2 are spaced closer together than the remaining bottom and top arcuate support segments 18 and 22. The arcuate support segments are preferably secured to the spring plates with L-shaped brackets 76. Resilient compressible spacers 78 are located between L-shaped brackets 76 and arcuate support segments 18 and 20 to allow longitudinal flexing of bottom spring plate 20 and top spring plate 24. Sets of wedges 28 are secured to bottom and top spring plates 20 and 24, one member of each set being secured to the top of bottom spring plate 20 and the other being secured to the bottom of top spring plate 24. Wedges 28 are preferably in vertical alignment with bottom and top arcuate support segments 18 and 22 to allow vertical forces transmitted by wedges 28 to be transferred directly to bottom and top arcuate support segments 18 and 22.

Secured to both sides of hydraulic wedge mandrel 10 is a plurality of retaining mechanisms 80. Each of retaining mechanisms 80 includes V-shaped member 82 secured to the side of center spring plate 26 and a pair of triangular members 84 that are complementary to V-shaped member 82, one member of each pair being secured to bottom spring plate 20 and the other member being secured to top spring plate 24, such that when hydraulic wedge mandrel 10 is in a collapsed position each pair of triangular members 84 is engaged with V-shaped member 82. Thus, hydraulic wedge mandrel 10 cannot be expanded without moving center spring plate 26 longitudinally relative to bottom and top spring plates 20 and 24.

While this invention has been described in relation to its preferred embodiments, it is to be understood that various modifications thereof will now be apparent to one skilled in the art upon reading this specification and it is intended to cover such modifications as fall within the scope of the appended claims.

We claim:

1. A mandrel for insertion in a pipe to prevent distortion during bending of said pipe comprising:

(a) top, middle and bottom spring plates normally positioned one above the other in parallel planes;

(b) segment means secured above said top plate and secured below said bottom plate forming upper and lower cylindrical contact surfaces;

(c) driven wedge means on the bottom of said top plate and the top of said bottom plate, said driven wedge means having a wedge surface of decreasing inclination;

(d) drive wedge means on said middle plate, said drive wedge means having a wedge surface of decreasing inclination and confronting the wedge surfaces of said driven wedge means; and (e) means to translate said middle plate longitudinally of said top and bottom plates to move said drive wedge means relative to said driven wedge means to engage the confronting wedge surfaces thereby moving said segments into contact with the inner wall of said pipe preparatory to bending the same in the region of contact.

2. In a pipe bending mandrel adapted for insertion into a pipe for supporting the pipe against distortion where a top assembly defines a top cylindrical segment and a bottom assembly defines a bottom cylindrical segment of a cylinder in which said assemblies are movable away from each other for engagement with the pipe, the improvement which comprises:

(a) a top spring plate beneath said top assembly;

(b) a bottom spring plate above said bottom assembly parallel to said top spring plate;

(c) top arcuate support segments secured to the top of said top spring plate and secured to and spaced at predetermined distances along said top assembly, said top assembly including a set of buckle preventing springs mounted on said support segments;

(d) bottom arcuate support segments secured to the bottom of said bottom spring plate and secured to and spaced at predetermined distances along said bottom assembly, said bottom assembly including a set of buckle preventing springs mounted on said support segments;

(e) a plurality of sets of wedges secured to opposite sides of said spring plates one member of each set being secured to the top of said bottom spring plate and the other being secured to the bottom of said top spring plate;

(f) a central spring plate positioned between said top and bottom spring plates parallel thereto and having wedges complementary and engageable with said wedges secured to said top and bottom spring plates; and (g) means for moving said central spring plate longitudinally of said cylindrical segments and relative to said top and bottom spring plates to engage said wedges of said top and bottom spring plates with said wedges of said center spring plate to move said assemblies from a first position where said assemblies are relatively close to each other to a second position away from each other and in contact with the top and bottom of said pipe.

3. The pipe bending mandrel as recited in claim 2 wherein said top and bottom assemblies are spaced apart in said first position less than the diameter of said cylinder.

4. The pipe bending mandrel as recited in claim 2 wherein said bottom assembly includes a set of blocks arrayed to define said bottom cylindrical segment and said top assembly includes a set of blocks arrayed to define said top cylindrical segment, said blocks being secured to said sets of buckle resisting springs.

5. The pipe bending mandrel as recited in claim 4 wherein said top assembly includes buckle resisting spring strips secured to said blocks and forming part of said top assembly that contacts the top of said pipe.

6. The pipe bending mandrel as recited in claim 5 wherein said blocks forming said top set have longitudinal grooves to receive said buckle resisting springs.

7. The pipe bending mandrel as recited in claim 2 wherein means for moving said central spring plate longitudinally includes a hydraulic cylinder and piston assembly, said cylinder being connected to said top and bottom spring plates and said piston being connected to said center spring plate.

8. The pipe bending mandrel as recited in claim 2 further comprising means for moving said mandrel into, along and out of said pipe, secured to said top spring plate whereby said means is in contact with the bottom portion of said pipe when said mandrel is in said first position and is not in contact with said pipe when said mandrel is in said second position.

9. In a pipe bending mandrel adapted for insertion into a pipe for supporting the pipe against distortion where a top assembly defines a top cylindrical segment and a bottom assembly defines a bottom cylindrical segment of a cylinder in which said assemblies are movable away from each other for engagement with the pipe, the improvement which comprises:

(a) a top spring plate beneath said top assembly;

(b) a bottom spring plate above said bottom assembly;

(c) top arcuate support segments secured to the top of said top spring plate and secured to and spaced at predetermined distances along said top assembly, said top assembly including a set of buckle preventing springs mounted on said support segments;

(d) bottom arcuate support segments secured to the bottom of said bottom spring plate and secured to and spaced at predetermined distances along said bottom assembly, said bottom assembly including a set of buckle preventing springs mounted on said support segments; and (e) a plurality of sets of wedges secured to opposite sides of said spring plates, one member of each set being secured to the top of said bottom spring plate and the other being secured to the bottom of said top spring plate, a central spring plate positioned between said top and bottom spring plates and having wedges complementary and engageable with said wedges secured to said top and bottom spring plates and means for moving said central spring plate longitudinally of said cylindrical segments and relative to said top and bottom spring plates to engage said wedges of said top and bottom spring plates with said wedges of said center spring plate to move said assemblies from a first position where said assemblies are relatively close to each other to a second position away from each other and in contact with the top and bottom of said pipe, wherein each of said wedges secured to said top and bottom spring plates and each of said complementary wedges secured to said center spring plate include first and second surfaces, said first surface having a greater degree of inclination than said second surface and when said assemblies are moved from said first position to said second position, said first surfaces of said top and bottom spring plates contact said first surfaces of said center spring plate to move said assemblies vertically away from each other as said center spring plate is moved longitudinally and as said center spring plate continues moving longitudinally, said second surfaces of said top and bottom spring plates contact said second surfaces of said center spring plate to move said assemblies to a second position in contact with the top and bottom of said pipe.

10. In a pipe bending mandrel adapted for insertion into a pipe for supporting the pipe against distortion where a top assembly defines a top cylindrical segment and a bottom assembly defines a bottom cylindrical segment in which said assemblies are movable away from each other from a collapsed position in which said segments are spaced apart less than the diameter of said cylinder to an expanded position in which said segments contact the top and bottom of said pipe, the improvement which comprises:

(a) a top spring plate beneath said upper assembly;

(b) a bottom spring plate above said bottom assembly;

(c) top arcuate support segments secured to the top of said top spring plate and secured to and spaced at predetermined distances along said top assembly;

(d) bottom arcuate support segments secured to the bottom of said bottom spring plate and secured to and spaced at predetermined distances along said bottom assembly; and (e) a plurality of sets of wedges secured to opposite sides of said spring plates, one member of each set being secured to the top of said bottom spring plate and the other being secured to the bottom of said top spring plate, each of said members of said wedges secured to said top and bottom spring plates and having a wedge surface of decreasing inclination, a central spring plate positioned between said top and bottom spring plates and having wedges complementary and engageable with said wedges secured to said top and bottom spring plates and means for moving said center spring plate longitudinally of said cylindrical segments relative to said top and bottom spring plates for moving said assemblies from said collapsed position to said expanded position such that when said assemblies are moved from said collapsed position to said expanded position, said first surfaces of said top and bottom spring plates contact said first surfaces of said center spring plate to move said assemblies vertically and apart from each other as said center spring plate is moved longitudinally, further longitudinal movement causing said second surfaces of said top and bottom spring plates to contact said second surfaces of said center spring plate to move said assemblies further apart to said expanded position.

11. In a pipe bending mandrel adapted for insertion into a pipe for supporting the pipe against distortion where a top assembly defines a top cylindrical segment and a bottom assembly defines a bottom cylindrical segment in which said assemblies are movable away from each other from a collapsed position in which said segments are spaced apart less than the diameter of said cylinder to an expanded position in which said segments contact the top and bottom of said pipe, the improvement which comprises:

(a) a top spring plate beneath said upper assembly;

(b) a bottom spring plate above said bottom assembly;

(c) top arcuate support segments secured to the top of said top spring plate and secured to and spaced at predetermined distances along said top assembly, said top assembly including a set of buckle preventing springs mounted on said support segments;

(d) bottom arcuate support segments secured to the bottom of said bottom spring plate and secured to and spaced at predetermined distances along said bottom assembly, said bottom assembly including a set of buckle preventing springs mounted on said support segments, wherein every top arcuate support segment has a corresponding bottom arcuate support segment secured in substantially identical vertical planes thereby forming pairs of arcuate support segments and between each pair of top and bottom arcuate support segments said wedges are secured to said top and bottom spring plates, (e) a plurality of sets of wedges secured to opposite sides of said spring plates, one member of each set being secured to the top of said bottom spring plate and the other being secured to the bottom of said top spring plate, each of said members of said wedges secured to said top and bottom spring plates includes first and second surfaces, said first surface having a greater degree of inclination than said second surface, a central spring plate positioned between said top and bottom spring plates and having wedges complementary and engageable with said wedges secured to said top and bottom spring plates and means for moving said center spring plate longitudinally of said cylindrical segments relative to said top and bottom spring plates for moving said assemblies from said collapsed position to said expanded position such that when said assemblies are moved from said collapsed position to said expanded position, said first surfaces of said top and bottom spring plates contact said first surfaces of said center spring plate to move said assemblies vertically and apart from each other as said center spring plate is moved longitudinally, further longitudinal movement causing said second surfaces of said top and bottom spring plates to contact said second surfaces of said center spring plate to move said assemblies further apart to said expanded position.

12. In a pipe bending mandrel adapted for insertion into a pipe for supporting the pipe against distortion where a top assembly defines a top cylindrical segment and a bottom assembly defines a bottom cylindrical segment in which said assemblies are movable away from each other from a collapsed position in which said segments are spaced apart less than the diameter of said cylinder to an expanded position in which said segments contact the top and bottom of said pipe, the improvement which comprises:

(a) a top spring plate beneath said upper assembly;

(b) a bottom spring plate above said bottom assembly;

(c) top arcuate support segments secured to the top of said top spring plate and secured to and spaced at predetermined distances along said top assembly, said top assembly including a set of buckle preventing springs mounted on said support segments;

(d) bottom arcuate support segments secured to the bottom of said bottom spring plate and secured to and spaced at predetermined distances along said bottom assembly, said bottom assembly including a set of buckle preventing springs mounted on said support segments;

(e) a plurality of sets of wedges secured to opposite sides of said spring plates, one member of each set being secured to the top of said bottom spring plate and the other being secured to the bottom of said top spring plate, each of said members of said wedges secured to said top and bottom spring plates includes first and second surfaces, said first surface having a greater degree of inclination than said second surface, a central spring plate positioned between said top and bottom spring plates and having wedges complementary and engageable with said wedges secured to said top and bottom spring plates and means for moving said center spring plate longitudinally of said cylindrical segments relative to said top and bottom spring plates for moving said assemblies from said collapsed position to said expanded position such that when said assemblies are moved from said collapsed position to said expanded position, said first surfaces of said top and bottom spring plates contact said first surfaces of said center spring plate to move said assemblies vertically and apart from each other as said center spring plate is moved longitudinally, further longitudinal movement causing said second surfaces of each top and bottom spring plates to contact said second surfaces of said center spring plate to move said assemblies further apart to said expanded position; and (f) said bottom and top assemblies including respectively bottom and top sets of blocks arrayed to define said cylindrical segments.

13. The pipe being mandrel as recited in claim 12 wherein said top assembly includes a plurality of buckle resisting longitudinal strips secured to the top of said blocks to contact the top of said pipe when said mandrel is in said position, said blocks having grooves therein to accommodate said strips.

14. In a pipe bending mandrel adapted for insertion into a pipe for supporting the pipe against distortion where a top assembly defines a top cylindrical segment and a bottom assembly defines a bottom cylindrical segment in which said assemblies are movable away from each other from a collapsed position in which said segments are spaced apart less than the diameter of said cylinder to an expanded position in which said segments contact the top and bottom of said pipe, the improvement which comprises:

(a) said top assembly includes a top set of blocks defining said top cylindrical segment;

(b) said bottom assembly includes a bottom set of blocks defining said bottom cylindrical segment;

(c) a longitudinally flexible top platform beneath said top set of blocks;

(d) a longitudinally flexible bottom platform above said bottom set of blocks;

(e) arcuate support segments secured to and spaced at predetermined distances along the top of said top platform and buckle resisting longitudinal strips secured to said arcuate support segments for supporting said top set of blocks;

(f) arcuate support segments secured to and spaced at predetermined distances along the bottom of said bottom platform and buckle resisting longitudinal strips secured to said bottom platform for supporting said bottom set of blocks; and (g) a plurality of sets of wedge, one member of each set being secured to the bottom of said top platform and the other being secured to the top of said bottom platform, said sets being positioned at opposite sides of said platforms, a longitudinally flexible center platform having wedges secured thereto complementary with and for supportably engaging said sets of wedges secured to said top and bottom platforms and means for moving said center platform longitudinally of said cylindrical segments and relative to said top and bottom platforms to move said assemblies into engagement with the top and bottom of said pipe, wherein said wedge surfaces secured to said top and bottom platforms and said complementary wedge surfaces secured to said center platform include first and second inclined surfaces, said first surface having a greater degree of inclination than said second surface.

15. The pipe bending mandrel as recited in claim 14 wherein the longitudinal movement of said center platform constitutes an expanding stroke, said expanding stroke initiating from a beginning zone in which the wedge surfaces of said top and bottom platforms are not supportably engaging the wedge surfaces of said center platform and said stroke having an intermediate zone in which longitudinal movement of said center platform causes said first wedge surfaces of said center platform to supportably engage and traverse the first wedge surfaces of said first and top bottom platforms to move said top and bottom assemblies away from each other and said stroke terminates in a final zone in which longitudinal movement of said center platform causes the second wedge surfaces of said center platform to supportably engage and traverse the second wedge surfaces of said top and bottom platforms thereby moving said assemblies apart and into contact with the top and bottom of said pipe and longitudinal movement of said center platform in a direction opposite of the longitudinal movement that occurs in the expanding stroke constitutes a collapsing stroke in which said top and bottom assemblies move towards each other.

* * * * *

UNITED STATES PATENT AND TRADEMARK OFFICE

CERTIFICATE OF CORRECTION

PATENT NO. : 4,352,285
DATED : October 5, 1982
INVENTOR(S) : Forrest N. LaRue and Lionel H. Wheeler It is certified that error appears in the above—identified patent and that said Letters Patent is hereby corrected as shown below:

Col. 1, line 12 change "to" to --of--.
Col. 1, line 59 change "an" to --and--.

Signed and Sealed this

*Twenty-ninth* Day of *March 1983*

[SEAL]

*Attest:*

GERALD J. MOSSINGHOFF

*Attesting Officer*

*Commissioner of Patents and Trademarks*